US006110131A

United States Patent [19]

Sleichter, III et al.

[11] Patent Number: 6,110,131

[45] Date of Patent: Aug. 29, 2000

[54] VIBRATING CHAIR WITH SHRINK-WRAPPED VIBRATOR

[75] Inventors: Charles G. Sleichter, III, Bellflower; Gayle B. Gerth, Dana Point, both of Calif.

[73] Assignee: JB Research, Inc., Bellflower, Calif.

[21] Appl. No.: 09/085,846

[22] Filed: May 28, 1998

[51] Int. Cl.[7] ..... A61H 23/02

[52] U.S. Cl. ..... 601/57; 601/70

[58] Field of Search ..... 601/46, 49, 50, 601/53, 54, 56–61, 65, 70, 78, 86, 87, 90, 93; 5/674, 694, 915; 297/217.1, 217.3

[56] References Cited

U.S. PATENT DOCUMENTS

| | | |
|---|---|---|
| 2,873,392 | 2/1959 | Rich . |
| 2,897,641 | 8/1959 | Simon et al. . |
| 3,033,358 | 5/1962 | Mantell et al. . |
| 3,204,385 | 9/1965 | Remer et al. . |
| 3,450,253 | 6/1969 | Nielsen . |
| 3,457,911 | 7/1969 | Carpenter . |
| 3,464,405 | 9/1969 | Kallus . |
| 3,641,725 | 2/1972 | Grisell . |
| 3,727,607 | 4/1973 | Dill . |
| 3,948,379 | 4/1976 | Warner . |
| 3,978,181 | 8/1976 | Vahle . |
| 4,135,826 | 1/1979 | Holm . |
| 4,136,685 | 1/1979 | Ramey . |
| 4,257,408 | 3/1981 | Ramey . |
| 4,496,866 | 1/1985 | Yamamoto et al. . |
| 4,559,929 | 12/1985 | Hseu . |
| 4,676,405 | 6/1987 | Lents et al. . |
| 4,920,583 | 5/1990 | Hough et al. . |
| 4,935,972 | 6/1990 | Brady . |
| 5,016,616 | 5/1991 | Hu . |
| 5,022,384 | 6/1991 | Freels et al. . |
| 5,134,248 | 7/1992 | Kiec et al. . |
| 5,211,873 | 5/1993 | Dams et al. . |
| 5,220,783 | 6/1993 | Cherry et al. . |
| 5,291,088 | 3/1994 | Adam et al. . |
| 5,334,897 | 8/1994 | Ineson et al. . |
| 5,344,437 | 9/1994 | Pistay . |
| 5,437,607 | 8/1995 | Taylor . |
| 5,624,155 | 4/1997 | Bluen et al. . |

*Primary Examiner*—Danton D. DeMille
*Attorney, Agent, or Firm*—Sheldon & Mak; Denton L. Anderson

[57] ABSTRACT

A vibrating massage furniture cushion and a method for making such cushion is provided. The cushion is created by enclosing an electric motor-driven vibrator in a flexible material, such as a shrink-wrap plastic material, suspending the vibrator within a cushion-making form and creating the foam cushion by reacting one or more foam precursor chemicals within the form. As the foam is created, it automatically envelopes the vibrator, thereby rigidly retaining the vibrator in place within the cushion. Because the vibrator has been surrounded with the thin flexible material, the foam cannot enter the motor area during the foam creation step. Therefore, the foam creation step does not damage the motor or otherwise make it inoperable. The invention provides a simple and efficient way of making cushion-containing vibration massage articles without having to go through the step of sculpting out a recess for the vibrator within a finished cushion article.

10 Claims, 3 Drawing Sheets

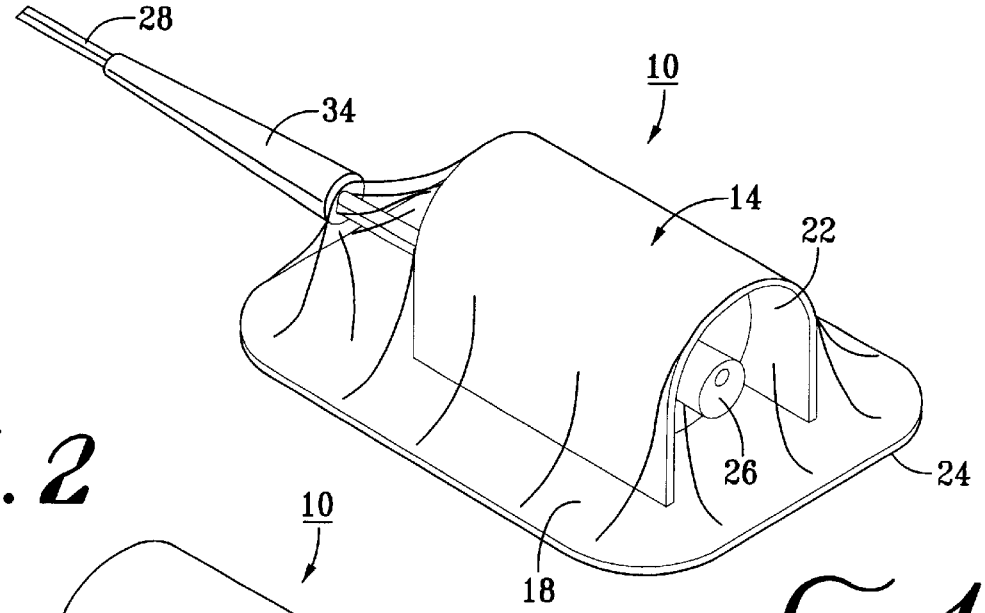
FIG. 1
FIG. 2
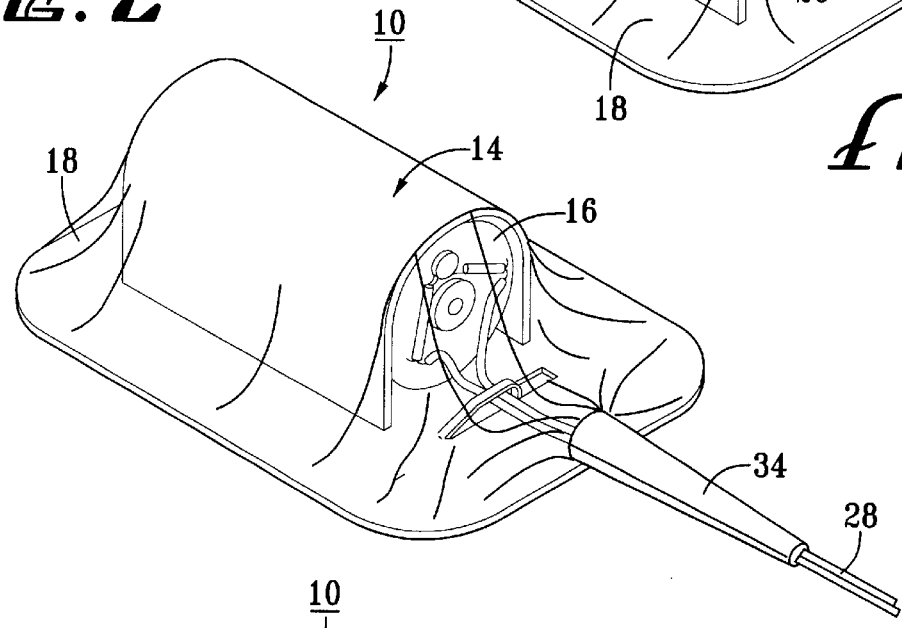
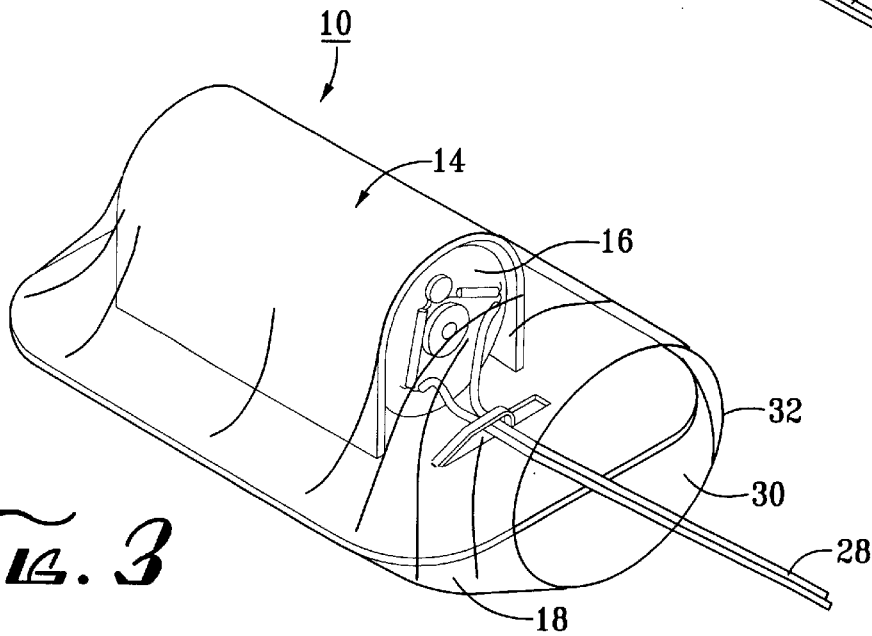
FIG. 3

VIBRATING CHAIR WITH SHRINK-WRAPPED VIBRATOR

FIELD OF THE INVENTION

This invention relates generally to the field of vibrating and pulsing massage furniture and, more specifically, to vibrating and pulsing massage furniture having an electromechanical vibrator inset within a foam cushion.

BACKGROUND OF THE INVENTION

Vibrating and pulsing massage furniture articles, such as chairs, recliners, vehicular seats, aircraft seats, beds, etc. have become very popular. In the most common type of such furniture articles, an electric motor-driven vibrator is disposed within a cushion which forms a part of the furniture article. The vibrator is disposed near the surface of the cushion, so that when the user of the furniture article rests against the cushion, vibrations created by the vibrator stimulate surface muscles and chemodynamic systems of the user so as to massage, relax and alert the user.

One problem which has arisen with respect to such vibrating and pulsing massage furniture articles is how to assure that moisture is not allowed to reach the vibrator's electrical components. This is especially a problem where the vibrator is disposed within the seat cushion portion (as opposed to a back cushion portion) of the furniture article. It is also especially a problem where the furniture article is used as an airliner seat, theater seat or seat for the elderly or infirm—applications where the inadvertent spilling of liquids onto the furniture article is a distinct possibility.

Another problem which has arisen with respect to vibrating and pulsing massage furniture articles has to do with the manufacture of such articles. The cushions into which the vibrators are disposed are most commonly composed of a resilient foam material, such as a soft polyurethane. Such foams are most commonly manufactured by reacting a liquid thermoplastic precursor with an activating material. The reaction of these two chemicals is carried out such that a gaseous reactant product, commonly termed a "blowing agent," is created. In the chemical reaction, the blowing agent creates tiny cells within the material, so that the resulting end product is a dry, resilient foam material.

In the manufacture of prior art vibrating and pulsing massage furniture articles, the vibrator is inset within the foam cushion by sculpting an inset into the finished foam. This, however, is an awkward and expensive procedure. In order to dispose the vibrator within the cushion in a way that the vibrator is rigidly retained, the foam must be carefully sculpted so as to form an inset cavity which precisely matches the dimensions of the vibrator.

Manufacturing and assembly of vibrating and pulsing massage furniture would be much more efficient if the vibrator were installed within the cushion "in situ," that is, installing the vibrator within the cushion mold during the foam-creating reaction. In situ installation would allow the foam to naturally envelop the vibrator and closely conform to the dimensions of the vibrator. However, in situ installation has heretofore seemed impossible because, as the foam is formed during the chemical reaction, the internal pressures created within the developing foam cause the foam to work its way into the internals of the electric motor portion of the vibrator, thereby making the motor inoperable.

Accordingly, there is a need for an improved vibrating and pulsing massage furniture cushion which is properly protected from moisture and whose manufacture does not require the sculpting or cutting of the finished foam.

SUMMARY

The invention satisfies this need. The invention is a method for manufacturing a vibrating massage device comprising the steps of enclosing a vibrator within a thin, flexible material, suspending the vibrator within a mold and, thereafter, reacting one or more chemicals to create a foam which fills the mold to form a cushion and, while so doing, at least partially surrounds the vibrator.

In a preferred embodiment, the flexible material is a shrink-wrap plastic material.

In the invention, the use of a flexible material for covering the vibrator has been found to effectively prevent the incursion of foam within the vibrator motor. Surprisingly, it has been found that the resulting vibrating cushion operates substantially identically to prior art vibrating cushions wherein the vibrator is not enclosed in a flexible material.

The invention is also a vibrating massage device comprising a cushion having a vibrator disposed therein, the vibrator being physically separated from the foam by a thin, flexible, liquid-impervious material, such as shrink-wrap plastic.

DRAWINGS

These features, aspects and advantages of the present invention will become better understood with regard to the following description, appended claims and accompanying figures where:

FIG. 1 is a perspective view of a vibrator having features of the invention;

FIG. 2 is a reversed perspective view of the vibrator illustrated in FIG. 1;

FIG. 3 is a perspective view of a vibrator being covered with a shrink wrap according to the invention;

DETAILED DESCRIPTION

Figure 4:
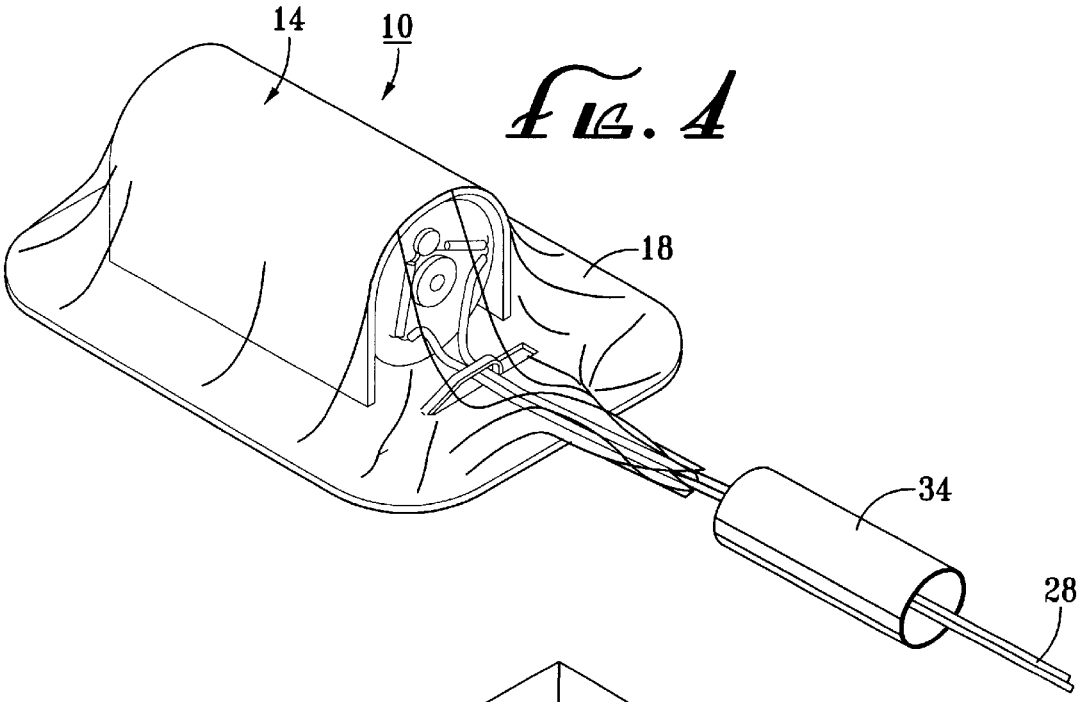
FIG. 4 is a perspective view of the vibrator illustrated in FIG. 3 showing further steps in completion of manufacture.
Figure 5:
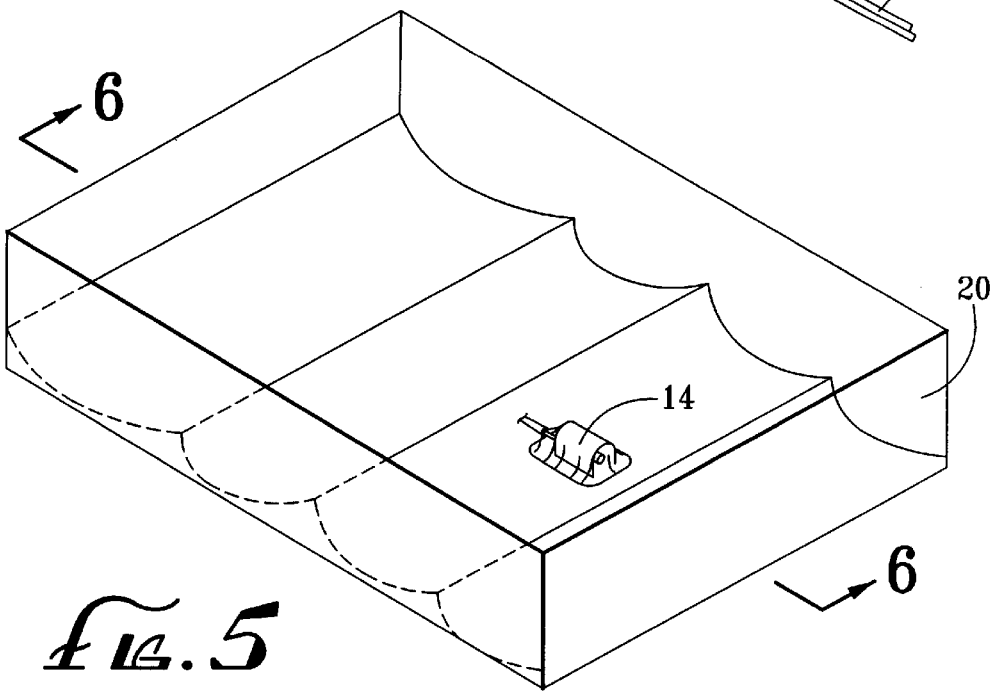
FIG. 5 is a perspective view of a cushion mold illustrating a vibrator having features of the invention disposed therein.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is an article of manufacture 10 and a method for manufacturing that article 10. As illustrated in FIGS. 1 and 2, the article 10 is a vibrating massage device comprising a foam cushion 12 and a vibrator 14. The vibrator 14 is driven by an electric motor 16. The vibrator 14 is disposed within the cushion 12 such that the vibrator 14 is at least partially surrounded by the foam in the cushion 12. In the invention, the electric motor 16 is separated from the foam by a flexible, liquid-impervious material 18.

The cushion 12 can be made from any foam material known in the prior art. Typically, the cushion 12 is made from a thermoplastic foam, such as a soft, resilient polyurethane. Such foams are generally created by reacting polyurethane precursor chemicals, including a blowing agent, within a mold 20 to create a solid foamed article 12 which conforms to the dimensions of the mold 20.

The vibrator 14 can be any of the many electrical vibrating devices known in the prior art. Typically, such vibrators 14 include a small electric motor 16 disposed in a frame 22 which has at least one generally flat vibration surface 24. The electric motor 16 rotates an eccentric weight 26 disposed at the end of the motor drive shaft. The rotation of the eccentric weight 26 causes the frame 22 to vibrate. The electric motor 16 can be powered by 110/120 volt AC electricity, supplied from a suitable electrical outlet via electrical power wires 28, or by DC voltage—as is typically available where the article of the invention 10 is used in an automobile.

The flexible material 18 surrounding the vibrator 14 is typically a thin plastic material. Preferably, the flexible material 18 is a shrink-wrap plastic material, such as the many shrink-wrap plastic materials known in the prior art. A typical shrink-wrap material useable in the invention is manufactured by 3M Company of St. Paul, Minn. as Product No. HSS-18-B. This material is a polyolefin plastic material.

Typically, the flexible material 18 has a thickness between about 1 mil and about 5 mils, preferably between about 2 mils and about 4 mils. Thicker materials will tend to absorb vibrations created by the vibrator. Thinner materials may fail during manufacture of the foam cushion.

The flexible material 18 should be capable of withstanding the temperatures created in the foaming process. For polyurethane foam, such temperatures are typically between about 250° F. and about 300° F. Preferably, the flexible material 18 adheres to the vibrator 14 in such a way that the flexible material 18 is taut. When taut, the danger of the flexible material 18 being pressured into the electrical motor 16 during the foam creation process is eliminated.

As illustrated in FIGS. 3 and 4, the article of the invention 10 can be manufactured in the following way. The vibrator 14 is wrapped with a shrink-wrap plastic material 18, such that all sides are enclosed within the material 18 except for an opening 30 provided out from which the electrical power wires 28 are strung. The heat-shrink plastic 18 is shrunk, generally by applying heat to the material 18. After the material 18 is shrunk, the material 18 tautly surrounds at least the vibrator motor 16—and generally the entire vibrator assembly 14—except for the opening 30 out from which the electrical power wires 28 are strung. Thereafter, the periphery 32 of the opening 30 is formed tightly around the electrical power wires 18 as illustrated in FIG. 4, such as by twisting the periphery 32 so that the flexible material 18 closely adheres to the electrical power wires 28.

In a preferred embodiment, the vibrator is further sealed within the flexible material 18 by placing a shrink-wrap sleeve 34 over that portion of the flexible material 18 which is closely adhered to the electrical power wires 28, and then shrinking the sleeve 34 so that it tightly retains the flexible material 18 against the electrical power wires 28 (as illustrated in FIGS. 1 and 2). Use of such sleeve 34 effectively seals the vibrator 14 within the flexible material 18. A typical heat shrink sleeve 34 is a heat shrink tubing article made from a heat shrinkable polyolefin, such as manufactured by Alpha Wire & Cable Co. of Elizabeth, N.J.

Once the vibrator 14 is encased within the flexible material 18, the vibrator 14 can be conveniently and efficiently disposed within a foam cushion 12. This can be accomplished by suspending the vibrator 14 within the mold 20 used to form the foam cushion 12 and, thereafter, forming the cushion 12 within the mold 20 by reacting one or more foam-creating chemicals. As the foam develops within the mold 20, it closely adheres to the vibrator 14, so that the vibrator 14 is rigidly retained within the finished cushion 12.

Figure 6:
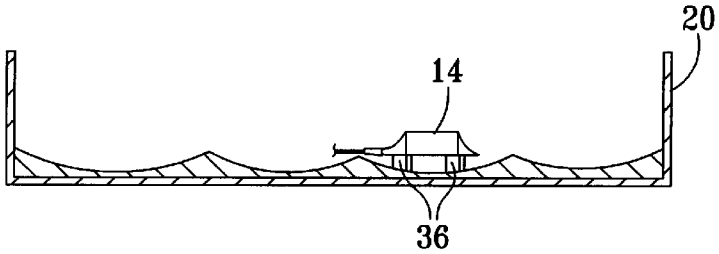
FIG. 6 is a cross-sectional side view of the mold illustrated in FIG. 5 taken along line 6—6.

As illustrated in FIG. 6, the vibrator 14 is preferably retained within the mold 20 by electromagnets 36 which tightly retain the vibrator 14 in place and prevent it from being moved within the mold 20 by the pressures created within the developing foam. The vibrator 14 is generally suspended within the mold 20 such that the vibration surface 24 is proximate to the outside surface of the cushion 12. The vibration surface 24 can be disposed flush with the surface of the cushion 12, or as illustrated in FIG. 6, the vibration surface 24 can be inset from the surface of the cushion 12 by, for example, about one half inch. In such recessed embodiments, a layer of prefabricated foam (not shown) is typically then disposed over the vibration surface 24 of the vibrator 14 so that the outside surface of the cushion 12 is smooth.

Figure 7:
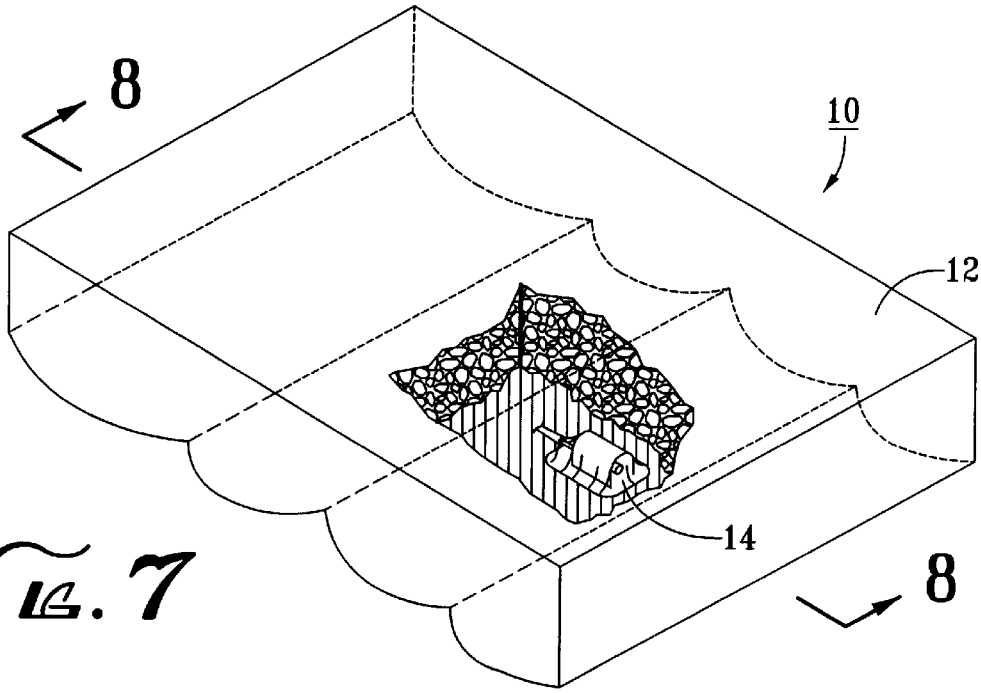
FIG. 7 is a perspective view of a vibrator-containing cushion having features of the invention.
Figure 8:
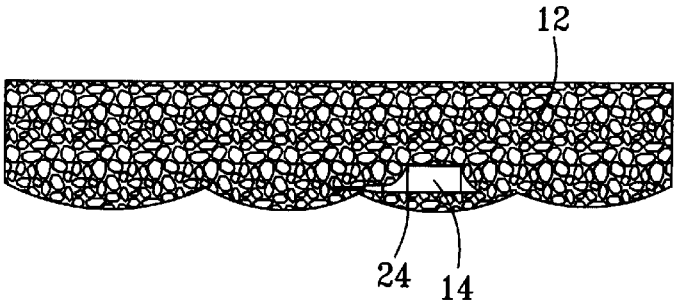
FIG. 8 is a cross-sectional side view of the cushion illustrated in FIG. 7 taken along line 8—8.

FIGS. 7 and 8 illustrate the finished article of the invention 10 as it is removed from the mold 20. In this embodiment, the vibrator 14 is disposed with the vibration surface 24 inset slightly from the external surface of the cushion 12.

The invention has been found to provide a convenient method of manufacturing cushion-containing vibrating massage units. With the invention, the vibrator can be suspended directly within the cushion molds, so that the cushion foam automatically surrounds and retains the vibrator. Thus, by the invention, the costly step of precisely sculpting out a recess in the foam for installation of the vibrator is eliminated.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A vibrating massage device comprising:

(a) a cushion comprised of a thermoplastic foam, the cushion being sized and dimensioned to cushion the body of a user of the device; and (b) a vibrator comprising an electric motor disposed within the cushion such that the vibrator is at least partially surrounded by the foam;

wherein the electric motor is separated from the foam by a taut, shrink-wrap plastic.

2. The vibrating massage device of claim 1 further comprising electrical power wires running from the electrical motor and wherein a portion of the flexible material is twisted around the electrical power wires.

3. The vibrating massage device of claim 2 further comprising a sleeve tautly disposed around that portion of the flexible material which is twisted around the electrical power wires.

4. The vibrating massage device of claim 3 wherein the sleeve is heat-shrunk onto the flexible material.

5. The vibrating massage device of claim 1 wherein the shrink-wrap plastic is a polyolefin.

6. A vibrating massage device comprising:

(a) a cushion comprised of a foam, the cushion being sized and dimensioned to cushion the body of a user of the device;

(b) a vibrator comprising an electric motor and disposed within the cushion such that the vibrator is at least partially surrounded by the foam; and (c) electrical power wires running from the electrical motor;

wherein the electric motor is separated from the foam by a flexible, liquid-impervious material; and wherein the flexible material is tightly adhered to the electrical power wires.

7. The vibrating massage device of claim 6 wherein a portion of the flexible material is twisted around the electrical power wires.

8. The vibrating massage device of claim 6 further comprising a sleeve tautly disposed around that portion of the flexible material which is tightly adhered to the electrical power wires.

9. The vibrating massage device of claim 8 wherein the sleeve is heat-shrunk onto the flexible material.

10. The vibrating massage device of claim 9 wherein the sleeve is made from a heat-shrinkable polyolefin.

* * * * *